US005775591A

United States Patent [19]

Fauci

[11] Patent Number: 5,775,591

[45] Date of Patent: Jul. 7, 1998

[54] PORTABLE PRESSURE CLEANING DEVICE

[76] Inventor: Dino A. Fauci, 24773 W. Sand Wedge La., Valencia, Calif. 91355

[21] Appl. No.: 696,593

[22] Filed: Aug. 16, 1996

[51] Int. Cl.[6] ..... B05B 9/08; E03B 9/20

[52] U.S. Cl. ..... 239/304; 239/373; 239/391; 239/375

[58] Field of Search ..... 239/373, 390, 239/391, 588, 148, 304, 389, 293, 305, 152, 154, 375, 35; 4/601, 609, 516

[56] References Cited

U.S. PATENT DOCUMENTS

| | | | |
|---|---|---|---|
| 211,234 | 1/1879 | Giffard . | |
| 239,525 | 3/1881 | McMullen . | |
| D. 251,794 | 5/1979 | Smith | D23/23 |
| D. 285,479 | 9/1986 | Hengesbach | D23/20 |
| D. 286,906 | 11/1986 | Gibbs | D23/17 |
| D. 288,586 | 3/1987 | Moskalik | D23/2 |
| D. 312,297 | 11/1990 | Ballu | D23/225 |
| D. 327,528 | 6/1992 | Sears et al. | D23/225 |

(List continued on next page.)

FOREIGN PATENT DOCUMENTS

| | | | |
|---|---|---|---|
| 2401746 | 4/1979 | France | 239/373 |

OTHER PUBLICATIONS

Waldrum, Low Cost Applicator and Method of Use, Mar. 5, 1991, From Patent O.G., U.S. Patent No. 4,997,129.

Ellison, Container and Pump Assembly, Jan. 15, 1991, From Patent O.G., U.S. Patent No. 4,984,742.

Gallo, Hand Pressure Sprayer, Aug. 12, 1957, From Patent O.G., U.S. Patent No. 3,002,698.

Norgren, Spray Gun, Nov. 19, 1929, Portion of U.S. Patent No. 1,736,357.

(List continued on next page.)

*Primary Examiner*—Kevin Weldon

*Attorney, Agent, or Firm*—Christie, Parker & Hale, LLP

[57] ABSTRACT

A compact portable cleaning device is provided that is useful for quick clean-up jobs. The device includes a water bottle with an integral hand pump for pressurizing the contents of the bottle. A hose is used to direct the pressurized water to either a spray nozzle or a portable faucet, either of which can be attached to the hose. The spray nozzle includes a trigger switch and an adjustable spray head which makes it useful for quickly rinsing an object. The portable faucet includes an integral valve for permitting the flow of a stream of water which makes the faucet useful for hands-free operation such as for washing one's hands. A carrying case is also provided with storage for the spray bottle and a spare bottle. The carrying case includes a bracket for permitting the portable faucet to be held in a convenient position for washing. Storage for soap such as a pump bottle of liquid soap is also provided with the carrying case as well as a small storage box for conveniently carrying the faucet, extra spray heads, or other useful items such as towels. The carrying case can be easily transported by the use of either a carrying handle or an adjustable shoulder strap.

12 Claims, 5 Drawing Sheets

U.S. PATENT DOCUMENTS

| | | | |
|---|---|---|---|
| D. 331,964 | 12/1992 | Hengesbach | D23/245 |
| 587,532 | 8/1897 | Morgan . | |
| 1,062,786 | 5/1913 | Miller | 239/25 |
| 2,156,783 | 5/1939 | Hovey et al. | 299/140 |
| 2,575,936 | 11/1951 | Andrews | 239/29.3 |
| 2,606,702 | 8/1952 | Chapman | 224/48 |
| 3,002,698 | 10/1961 | Gallo | 239/308 |
| 3,131,868 | 5/1964 | Coleman | 239/391 X |
| 3,142,443 | 7/1964 | Morgan | 239/373 X |
| 3,260,463 | 7/1966 | Giovansanti et al. | 239/373 X |
| 3,433,417 | 3/1969 | Poppitz | 239/304 |
| 3,750,196 | 8/1973 | Halferty | 4/625 |
| 4,380,306 | 4/1983 | Knopf | 222/89 |
| 4,527,742 | 7/1985 | Vogt et al. | 239/391 |
| 4,570,585 | 2/1986 | Johnston | 239/304 X |
| 4,590,628 | 5/1986 | DeGregorio | 239/25 X |
| 4,738,401 | 4/1988 | Filicicchia | 239/600 |
| 4,787,560 | 11/1988 | DeYoreo | 239/390 X |
| 4,919,311 | 4/1990 | Born | 222/401 |
| 4,984,742 | 1/1991 | Ellison et al. | 239/373 |
| 5,072,884 | 12/1991 | Ellison et al. | 239/373 |
| 5,082,185 | 1/1992 | Evans | 239/416.5 |
| 5,094,388 | 3/1992 | Chapman | 239/29.3 |
| 5,147,075 | 9/1992 | Regan | 222/402.15 |
| 5,251,344 | 10/1993 | Blomet | 4/602 |
| 5,251,345 | 10/1993 | Pechner | 4/603 |
| 5,284,300 | 2/1994 | Gries et al. | 239/373 |
| 5,301,877 | 4/1994 | Madison | 239/154 |
| 5,307,995 | 5/1994 | Jackson et al. | 239/373 |
| 5,620,140 | 4/1997 | Utter | 239/588 X |

OTHER PUBLICATIONS

Brandt, Dispensing Device, Jun. 1, 1937, Portion of U.S. Patent 2,082,146.

Huthsing, Fire Extinguisher Carrier, Aug. 12, 1952, Portion of U.S. Patent 2,606,701.

Santarelli, Sprayer, Jun. 26, 1956, Portion of U.S. Patent 2,752,200.

Anderson, Compression Sprayer, Sep. 23, 1958, Portion of U.S. Patent 2,853,212.

Pinke, Combined Sprayer Pump and Container Assembly, Oct. 3, 1961, Portion of U.S. Patent 3,002,699.

Smith, Method and Apparatus for Spraying Agrochemicals, Nov. 23, 1986 Portion of U.S. Patent 3,993,245.

Chow, Compressed Air Sprayer, Mar. 11, 1980, Portion of U.S. Patent 4,192,464.

Kelly, Self-Pressurizable Portable Vessle with Faucet Connector, Feb. 23, 1982, Portion of U.S. Patent 4,316,623.

Flueckiger, Method of Restoring an Indexable Cutting Insert for Reuse, Jul. 6, 1982, Portion of U.S. Patent 4,337,562.

Tada, Foam Dispenser, Sep. 21, 1982, Portion of U.S. Patent 4,350,298.

Stephenson et al., Remote Delivery Nozzle and Pressurized Container Assembly, Sep. 21, 1982, Portion of U.S. Patent 4,350,299.

Yoshino et al., Synthetic Resin Thin-Walled Bottle, Oct. 26, 1982 Portion of U.S. Patent 4,355,728.

Spengler et al., Portable Pressure Sprayer, Aug. 19, 1986, Portion of U.S. Patent 4,606,477.

Cunning, Combined Head and Handle Assembly for a Tank-Type Garden Sprayer, Jun. 14, 1988, Portion of U.S. Patent Des. 296,229.

Ellison, Self-Pressureizing Sprayer, Nov. 8, 1988, Portion of U.S. Patent 4,782,982.

Takano, Apparatus for Manufacturing Pipe Joint Portions, Nov. 22, 1988, Portion of U.S. Patent 4,785,517.

Raufeisen et al., Method of Assembling a Fuel Nozzle Assembly, Dec. 13, 1988, Portion of U.S. Patent 4,790,055.

Smith et al., Air Spring Seat and Air Pump, Mar. 7, 1989, Portion of U.S. Patent 4,809,944.

Dyck, Water Spray Nozzle Including Combined Intake Nozzle and Valve Structure, May 30, 1989, Portion of U.S. Patent No. 4,834,292.

Dyck, Water Spray Nozzle Including Combined Intake Nozzle And Valve Structure, Jul. 18, 1989, Portion of U.S. Patent No. 4,848,667.

Hengesbach, Flow Control Valve And Nozzle, Nov. 7, 1989, Portion of U.S. Patent Des. 304,487.

Hengesbach, Combined Flow Control Valve and Nozzle, Nov. 7, 1989 Portion of U.S. Patent Des. 304,488.

Ota et al., Biaxial-Orientation Blow-Molded Bottle-Shaped Container with Laterally Extending Grip Ribs, Jan. 2,1990, Portion of U.S. Patent 4,890,752.

Born, Pump Sprayer Pressure Tank or Similar Article, Oct. 9, 1990, Portion of U.S. Patent Des. 311,240.

Clivio, Sprayer, Mar. 26, 1991, Portion of U.S. Patent Des. 315,782.

Cassel, Container with Lid Seal, Oct. 6, 1992, Portion of U.S. Patent 5,152,416.

Johnson, et al., Pinch Trigger Water Gun with Rearwardly Mounted Hand Pump, Mar. 8, 1994, Portion of U.S. Patent 5,292,032.

D'Andrade, Controlled Flow, Bursting Water Gun Release Mechanism, Aug. 23, 1994, Portion of U.S. Patent 5,339,987.

Self-Pressurizable Protable Vessel with Faucet Connector, Feb. 23, 1982, Portion of U.S. Patent 4,316,623.

Portable Pressure Sprayer, Aug. 19, 1986, Portion of U.S. Patent 4,606,477.

PORTABLE PRESSURE CLEANING DEVICE

FIELD OF THE INVENTION

The present invention relates to a portable pressurized water washing device and, more particularly, to a washing device with a water bottle, a hand pump for pressurizing the water bottle, and a hose for directing the pressurized water from the bottle to either a nozzle for intermittently spraying pressurized water or a portable faucet for permitting a steady flow of pressurized water.

BACKGROUND OF THE INVENTION

Trigger operated spray bottles and squeeze bottles can be used for spraying water in order to quickly rinse an object where other sources of pressurized water are unavailable. However, such devices generally do not provide adequate water pressure or flow volume for use in many quick clean-up jobs such as for cleaning one's hands or for rinsing sand or dirt from one's feet or body. Portable showers are also known for providing a higher flow volume for permitting a person to shower while camping or while visiting the beach. However, many of these devices rely on a pressure head of a few feet created by the elevation of the water reservoir as the only source of pressurization of the water supply. Such devices generally cannot provide a sufficient pressurized flow for adequate rinsing of materials such as sticky sand from one's body.

Other portable devices rely on complicated pumping systems with external power sources in order to pressurize the water supply. These devices, while able to provide good pressure and flow for quick clean-up jobs, are generally too bulky to truly be considered portable.

SUMMARY OF THE INVENTION

The present invention is directed to a truly portable pressure cleaning device that is useful for quick clean-up jobs. The device is compact enough that it can be stored easily in the trunk of an automobile where it can be ready for use. For example, the device can be used to clean one's hands after changing an automobile tire. The device can also be used after a trip to the beach in order to rinse sand from a person's feet or legs before he or she gets in the automobile.

The device includes a water bottle with an integral hand pump for pressurizing the contents of the bottle. A hose directs the pressurized water to either a spray nozzle or a portable faucet, either of which can be attached to the hose. The spray nozzle includes a trigger switch and an adjustable spray head which makes it useful for quickly rinsing an object. The portable faucet includes an integral valve for permitting the flow of a stream of water which makes the faucet useful for hands-free operation such as for washing one's hands.

According to the invention, a carrying case is also provided with storage for the spray bottle and a spare bottle. The carrying case also includes a bracket for permitting the portable faucet to be held in a convenient position for washing. Storage for soap such as a pump bottle of liquid soap is also provided with the carrying case as well as a small storage box for conveniently carrying the portable faucet, extra nozzles or other useful items such as towels. The carrying case can easily be transported by the use of either a carrying handle or an adjustable shoulder strap.

Additional features of the invention will be described by the following detailed description and by the accompanying figures.

DETAILED DESCRIPTION

Figure 1:
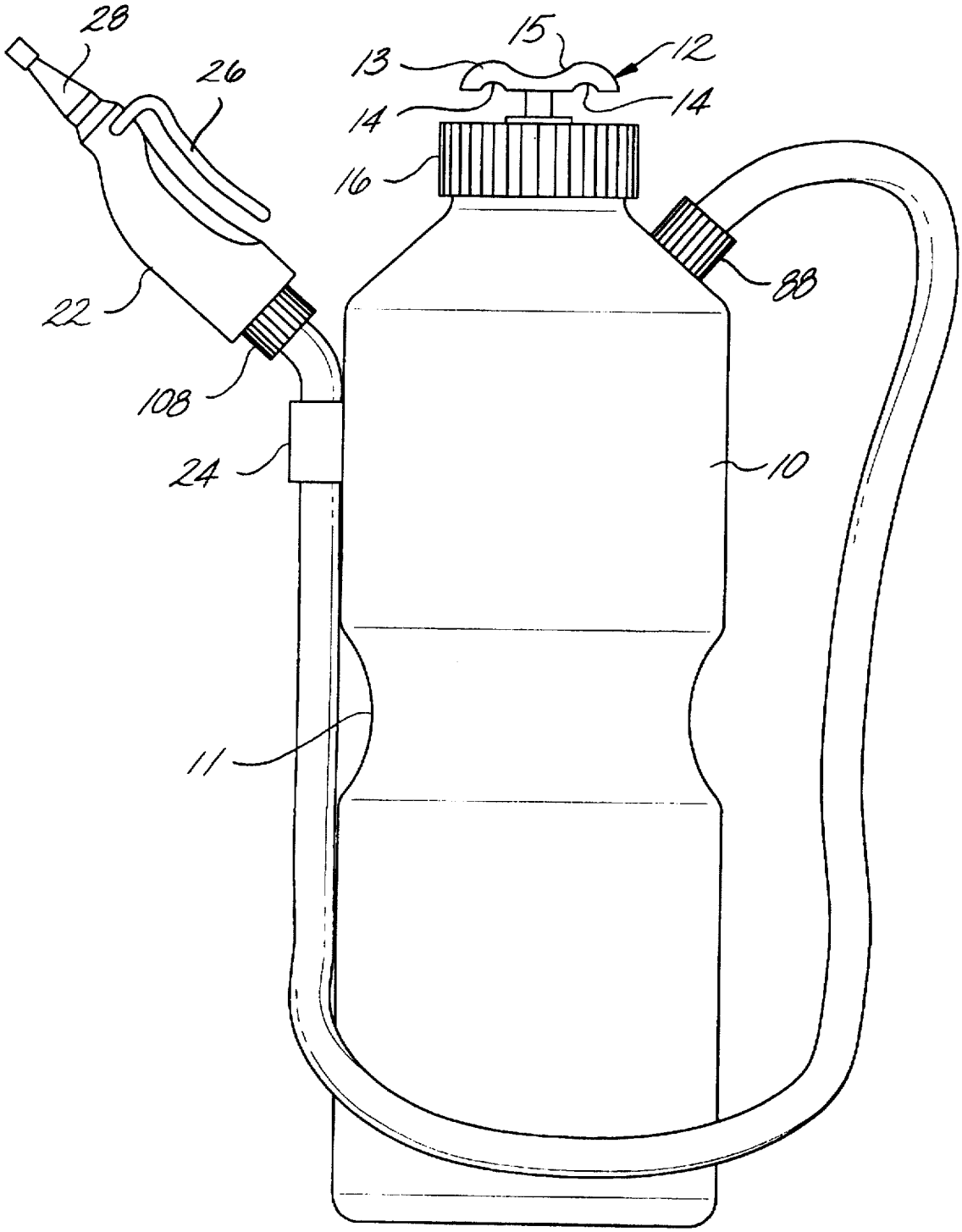
FIG. 1 is an elevation view of a portable cleaning device of the present invention.

Referring to FIG. 1, a spray bottle assembly is illustrated which can be used to provide a convenient source of pressurized water for quick clean up jobs. The device includes a water bottle 10 made of a durable corrosion resistant plastic material able to withstand the pressures encountered when the bottle is pressurized. Such a bottle can be produced by well-known methods such as blow molding techniques from polyethylene or other suitable plastics. The bottle is preferably about 4 to 6 inches in diameter and about 12 to 16 inches long such that it has a water volume of about 1 gallon. In order to make the bottle easy to grasp with one hand, it preferably includes an indented section 11 which forms a central waist portion around the circumference of the bottle that is about 4 inches in diameter. According to other embodiments, the bottle includes a pair of opposing ribbed indents or some other feature which permits the bottle to be easily grasped with one hand.

The bottle includes an integral pump 12 having a pump handle 13 for permitting the pressurization of the bottle with atmospheric air. The pump handle is ergonomically shaped with a pair of finger notches 14 and a thumb notch 15 which allow for a firm yet comfortable grasp of the pump handle to ease the pumping operation. A removable cap 16 permits the bottle to be opened up and refilled with ordinary tap water. Of course, while intended for water, some other liquid could similarly be pressurized by the device.

Once the bottle is pressurized, the water can be withdrawn from the bottle by hose 18 which extends from the bottle. A spray nozzle 22 is removably attached to the distal end of the hose. An optional C-shaped spring clamp 24 integral to the bottle is useful for holding the hose and nozzle when the device is not in use. According to another preferred embodiment, a molded indent is provided in the bottle for receiving and holding the nozzle. In yet another embodiment, a spring clamp is provided integral to the cap for holding the hose when the device is not in use.

The nozzle includes a trigger lever 26 which is used to operate a valve internal to the nozzle for permitting water to flow through the nozzle and from an adjustable spray head 28. The adjustable spray head is useful for directing an intermittent stream of pressurized water in a particular direction. Because it is adjustable, other desired spray patterns for quick clean-up jobs can also be selected. In another preferred embodiment, two separate nozzles are provided, one that provides a fan spray and one that provides a stream.

Figure 2:
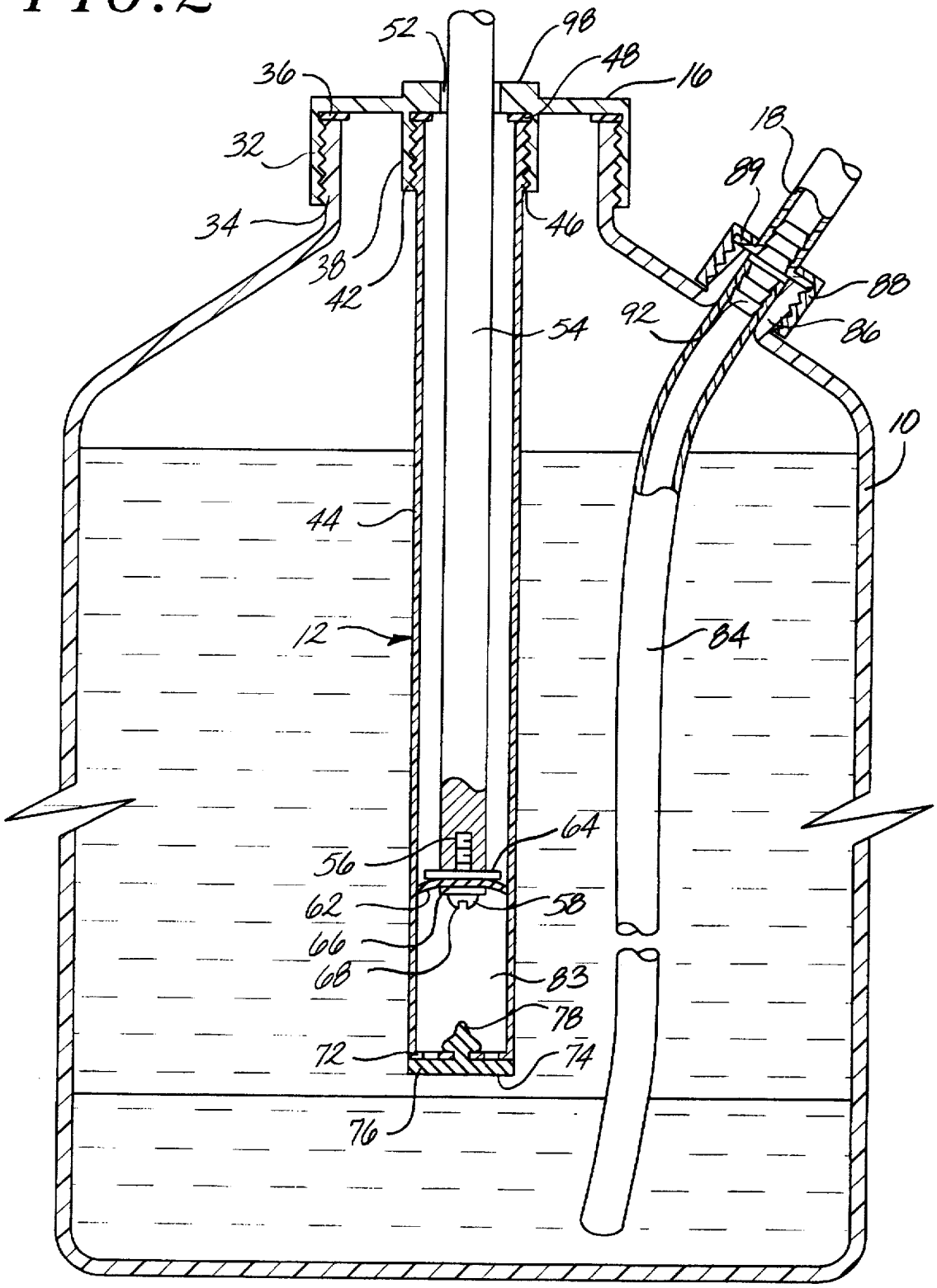
FIG. 2 is a cross-section view of the portable cleaning device of FIG. 1.

Referring to FIG. 2, the details of the bottle's interior and the pumping mechanism are illustrated in further detail. The cap is connected to the top of the water bottle by an internally threaded side wall 32 on the cap. The bottle has an externally threaded main neck portion 34 which cooperates with the thread of the cap. A cap gasket 36 provides a pressure-tight seal between the cap and the bottle. The cap further includes an inwardly extending cylindrical portion 38 having an internal thread 42 to which a pump cylinder 44 can be attached. The pump cylinder includes an upper, externally threaded portion 46 for mating with the internal thread of the cylindrical portion of the cap. A pump gasket 48 insures a pressure-tight seal between the pump cylinder and the cap.

An aperture 52 extending through the cap at the center of the cylindrical portion receives a pump shaft 54. The outermost end of the pump shaft is connected to the pump handle. The innermost end of the pump shaft includes a threaded aperture 56 for receiving a machine screw 58. The machine screw is used for fastening a plunger 62 to the end of the pump shaft. The plunger is made of an elastic material formed in a cup shape. A stiffening washer 64 located between the pump shaft and the plunger helps to prevent back flow of pressurized air from the pump cylinder to atmosphere. The stiffening washer is sized of a suitable diameter to prohibit back flow, yet is small enough to permit air flow around the stiffening washer and into the pump cylinder on the upstroke of the pump shaft. A washer 66 between the head 68 of the machine screw and the plunger helps to hold the plunger in place.

Figure 3:
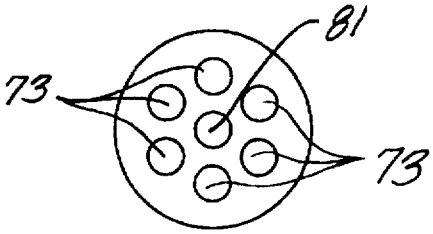
FIG. 3 is a bottom view of the pump cylinder with the check valve removed.

A perforated plate 72 as is best shown in FIG. 3 is located at the bottom of the pump cylinder to permit flow of the pressurized air from the pump cylinder into the water bottle through flow apertures 73. Referring back to FIG. 2, a check valve 74 including a flat disk portion 76 made of a resilient elastic material and a fastening portion 78 shaped somewhat like an arrowhead is fastened to the perforated plate by the insertion of the fastening portion through a central aperture 81 in the perforated plate.

On the upstroke of the pump shaft, air is drawn through the aperture in the cap, into the upper portion of the pump cylinder 82 and down around the resilient plunger to the lower pumping chamber 83 of the pump cylinder. On the downstroke, the air in the pumping chamber is compressed until the pressure within the pumping chamber exceeds the pressure within the bottle. Back flow of pressurized air back into the upper portion of the pump cylinder is prevented by the plunger. When the pressure within the pumping chamber exceeds the bottle pressure, the resilient disk of the check valve flexes downwardly allowing the flow of pressurized air through the flow apertures of the perforated plate and into the bottle. Of course, when the pressure within the bottle exceeds the pressure within the pumping chamber, the resilient disk of the check valve is forced upwardly, sealing the flow apertures of the perforated plate of the pump cylinder.

A siphon tube 84 is used to draw water from the bottle to a second externally threaded neck portion 86 of the bottle. The syphon tube extends down to near the bottom of the bottle so that virtually all of the water can be utilized. If the water level were to drop to below the tip of the syphon tube, air rather than water would flow through the syphon tube. An internally threaded hose cap 88 cooperates with a flared end 89 of the hose to seal the hose against the second neck portion of the bottle. A hollow tube coupler 92 having external ribs for gripping the inside of the hose and the syphon tube connects the siphon tube to the hose. When the bottle is pressurized with air, water is able to flow from the bottle, through the syphon tube, through the hose, and to the nozzle.

As mentioned previously, the bottle is preferably made of a durable plastic material capable of withstanding the pressures to which the bottle is subjected. The other components such as the nozzle, caps, pump shaft, pump handle, and pump cylinder are preferably made of a similarly durable plastic material. The hose should be of a flexible material to assist in directing the spray from the nozzle and to add to the device's portability. The plunger, check valve and various gaskets should be made of rubber or some other resilient material that permits an effective seal.

The device as described is particularly useful for quick clean-up jobs such as for the pressurized spraying of dirt or sand from a person's hands or other body parts. As mentioned above, the device is portable enough to be conveniently stored in an automobile. If a person were to spend the day at the beach, yet did not want to bring loose sand from his or her feet into the car, the water bottle could be quickly pressured by the use of the hand pump, and the nozzle could be used to direct a pressurized spray of water to remove the sand.

Figure 5:
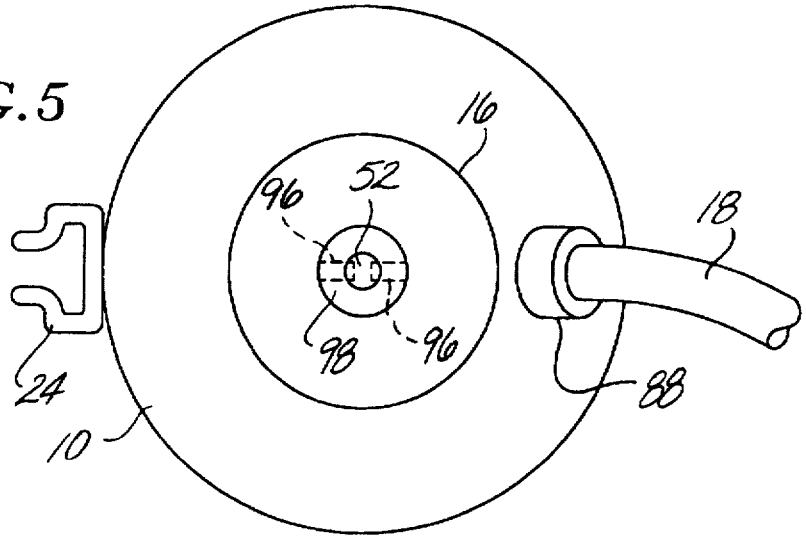
FIG. 5 is a plan view of the preferred device of FIG. 1 with the pump handle and pump shaft removed.
Figure 4:
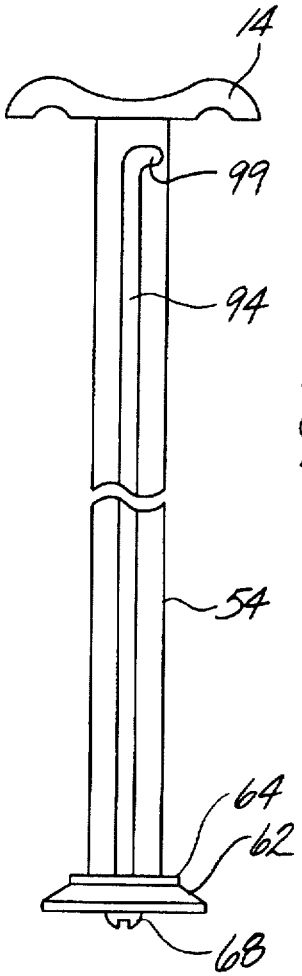
FIG. 4 is an elevation view of the preferred pump handle and pump shaft of the portable cleaning device.

Referring to FIGS. 4 and 5, the preferred pump shaft of the present invention includes one or more longitudinal slots 94 running most of the length of the pump shaft. The slots cooperate with one or more pins 96 which extend into the cap aperture at a shoulder portion 98 of the cap. The top of the slot includes an L-shaped bend 99 such that when the pump shaft has been fully inserted into the pump cylinder a twist of the handle will lock the pump handle in place and prevent it from moving up or down.

Figure 6:
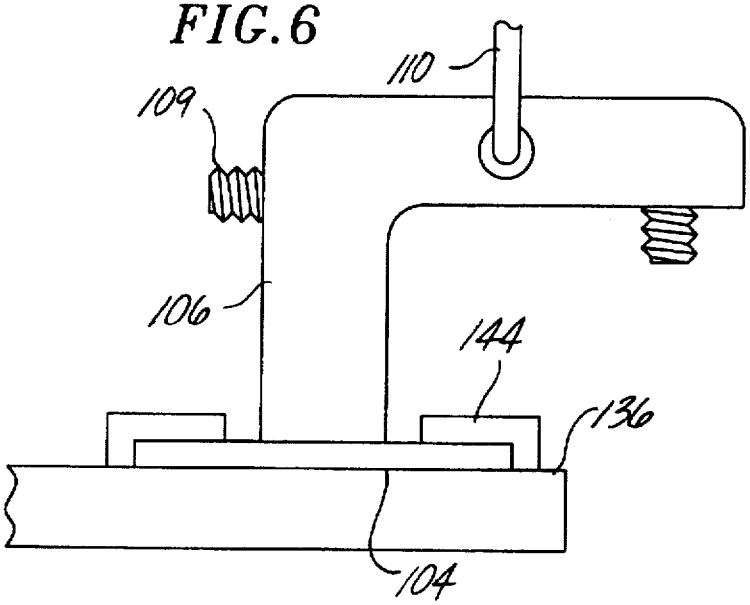
FIG. 6 is an elevation view of a portable faucet for use with the portable cleaning device.

While the device has generally been described as permitting a pressurized spray of water through a trigger operated nozzle, the device also includes a portable faucet 102 as illustrated in FIG. 6. The portable faucet is useful if a steady and continuous stream of water is preferred over an intermittent pressurized spray. The portable faucet includes a mounting flange 104 and a body portion 106 through which the water is permitted to flow. The hose is disconnected from the nozzle at hose connector 108 and the hose connector is fastened to inlet fitting 109 of the portable faucet. A valve lever 110 can be used to operate a valve internal to the body portion of the portable faucet. The valve permits flow through the body portion and out from an outlet fitting 112. If desired, the spray head 28 of the nozzle can be removed from the nozzle and fastened to the portable faucet at the outlet fitting. Of course, as with the nozzle, one or more different spray heads can be provided with different spray patterns.

Figure 7:
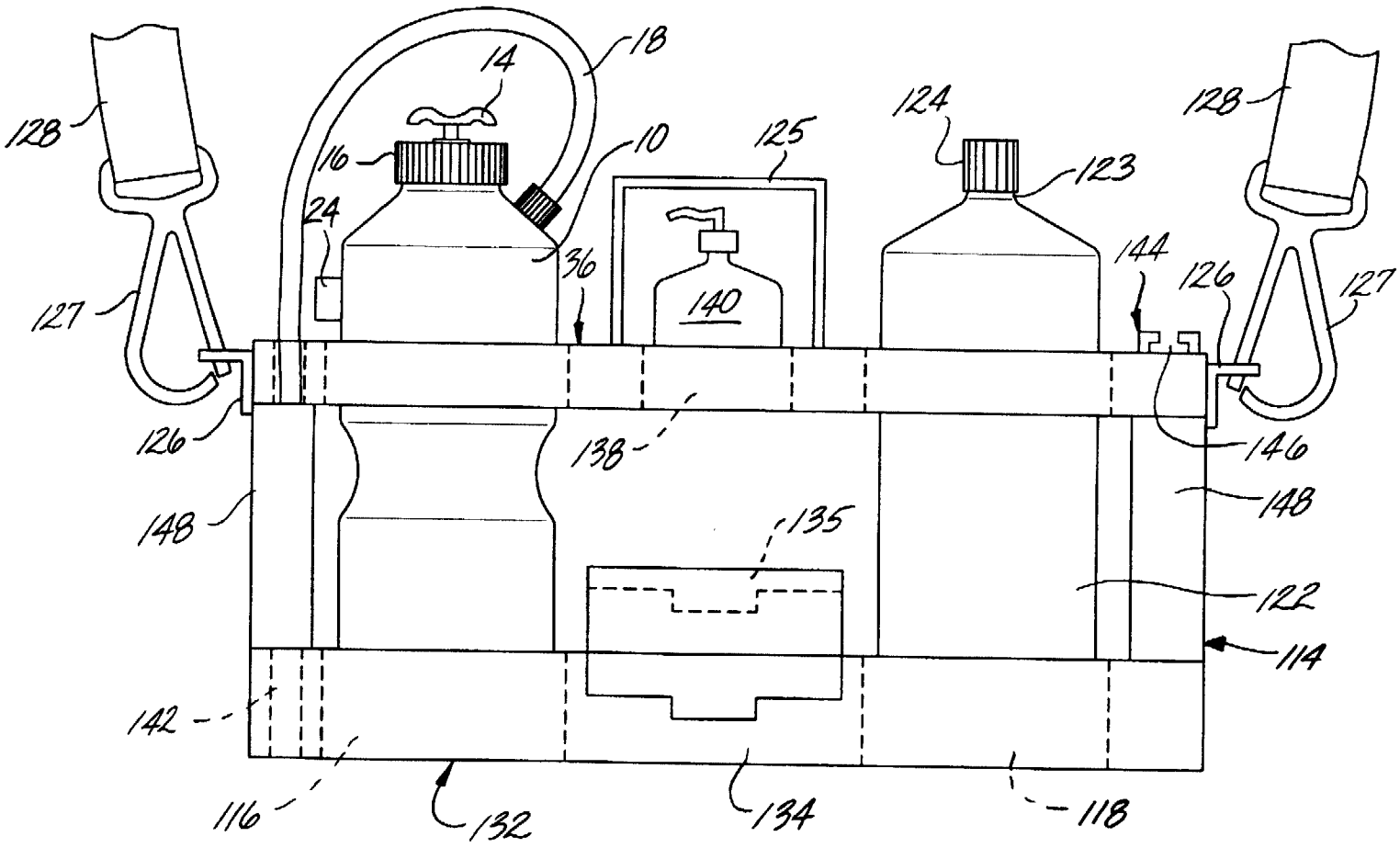
FIG. 7 is an elevation view of the entire portable cleaning device including its carrying case.
Figure 8:
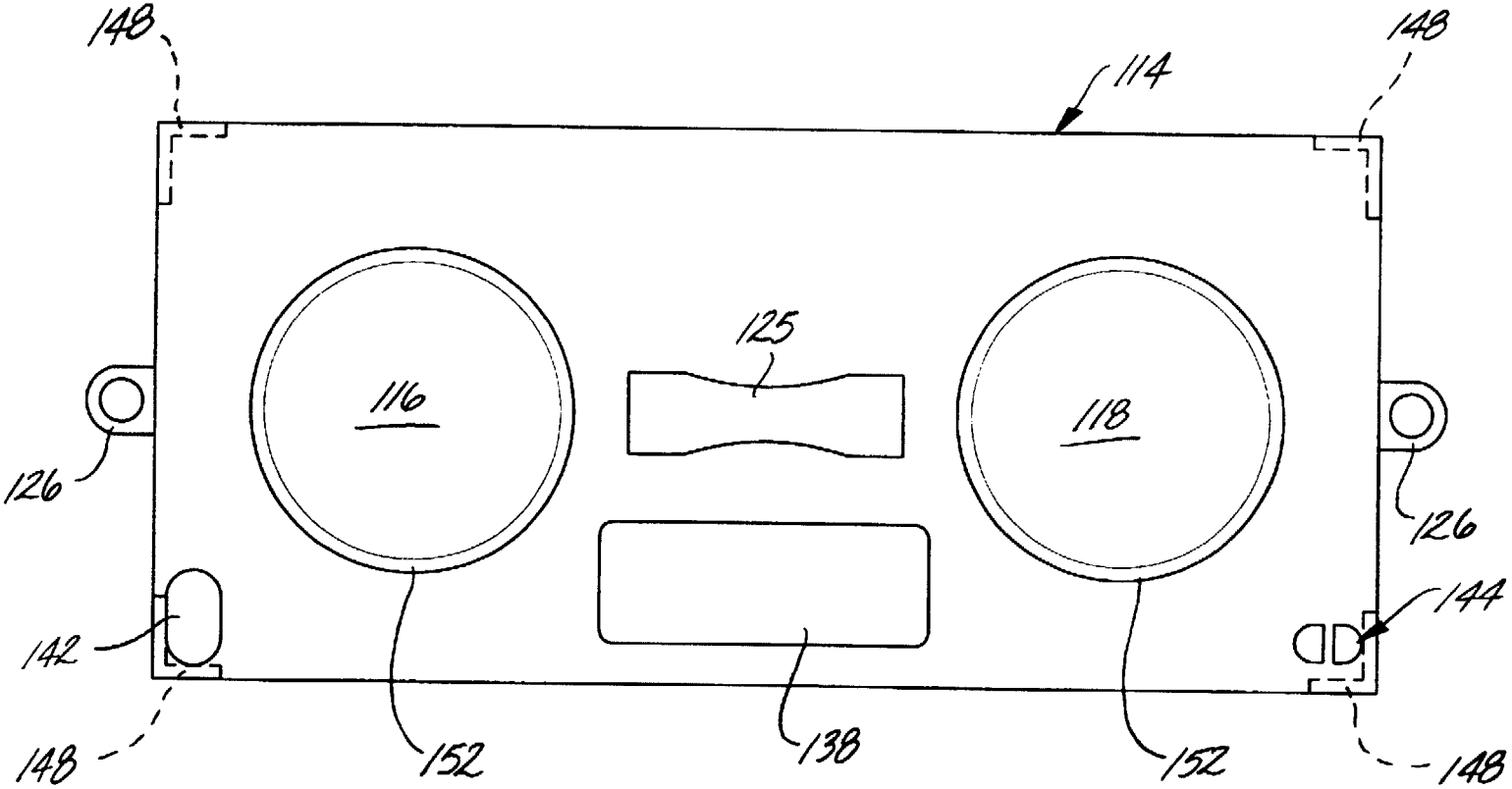
FIG. 8 is a plan view of the carrying case of the portable cleaning device of FIG. 7.

According to the preferred embodiment, the device also includes a convenient carrying case 114 as illustrated in FIGS. 7 and 8. The carrying case includes a first opening 116 for holding the water bottle. A second opening 118 is provided for carrying a spare water bottle 122. The spare water bottle can be of a similar design as the main bottle but is preferably of a simpler design. In the preferred embodiment, the spare bottle is only used to carry extra water for refilling the main water bottle when empty. Since it is not subjected to the pressure of the main water bottle, it can be of a thinner plastic material. A smaller threaded neck 123 and cap 124 are provided on the spare water bottle to more easily pour water from the spare water bottle to the main water bottle. Rubber seals 152 are provided around the circumference of the base of the first and second openings to hold the water bottle and spare bottle firmly in the carrying case. Either bottle can be inserted within its respective opening by pushing and twisting the bottle downwardly into the opening.

A convenient carrying handle 125 is also provided as well as a pair of mounting clips 126 for receiving the hook ends 127 of an adjustable shoulder strap 128. The bottom portion 132 of the carrying case also includes a convenient storage box 134 between the first and second bottle openings. The hinged top 135 of the storage box is illustrated in FIG. 7 in phantom. The top portion 136 of the carrying case also includes a third opening 138 for the convenient storage of a soap dispenser such as a pump-type liquid soap dispenser 140 as illustrated in FIG. 7. A fourth opening 142 is provided for storage of the spray nozzle and hose.

A mounting bracket 144 is provided on the top of the carrying case for attaching the portable faucet. A channel 146 in the mounting bracket receives the lower flange portion of the portable faucet to firmly hold the portable faucet in place. When the portable faucet is attached to the top of the carrying case, the portable faucet can be used to provide a steady stream of water in a hands-free operation.

Preferably, the top and bottom sections of the carrying case are made of a moldable plastic material. The top and bottom sections are separated by four upright posts 148 which are also made of a durable plastic material. Preferably the posts are of a plastic with an angled cross-section which provides strength without significantly adding to the weight of the carrying case.

Having described the preferred embodiment of the present invention, it is apparent that several modifications may be made while keeping within the spirit and scope of the following claims.

What is claimed is:

1. A portable washing system comprising:

a hand-held water bottle;

an air pump integral to the water bottle for pressurizing the water bottle;

a handle for operating the air pump;

a hose for directing water from the water bottle;

a spray nozzle that can be removably attached to the hose, the spray nozzle having a trigger operated valve for remotely allowing intermittent flow of pressurized water from the water bottle;

a faucet that can be removably attached to the hose, the faucet including an on-off valve for remotely permitting a steady, high volume stream of water to flow from the pressurized water bottle; and a carrying case for carrying the water bottle and for removable attachment of the faucet.

2. The portable washing system of claim 1 further comprising a spare water storage container and wherein the carrying case further comprises means for carrying the spare water bottle.

3. The portable washing system of claim 1 further comprising a soap dispenser.

4. The portable washing system of claim 1 wherein the carrying case further comprises a storage compartment.

5. The portable washing system of claim 1 wherein the water bottle includes a waist portion for permitting the water bottle to be easily grasped.

6. A portable washing system comprising:

first and second water bottles;

a hand operated air pump integral to the first water bottle for pressurizing the first water bottle;

a hose for directing water from the first water bottle;

a spray nozzle that can be removably attached to the hose, the spray nozzle having a trigger operated valve for allowing intermittent flow of pressurized water from the hose;

a faucet that can be removably attached to the hose, the faucet including an on-off valve for permitting a steady high volume stream of water to flow from the hose; and a carrying case for carrying the first and second water bottles, the carrying case further comprising a mounting bracket integral to the carrying case for mounting the faucet to the carrying case.

7. The portable washing system of claim 6 further comprising a soap dispenser.

8. The portable washing system of claim 6 further comprising a storage compartment.

9. A portable washing system comprising:

first and second water bottles:

a hand operated air pump integral to the first water bottle for pressurizing the first water bottle;

a hose for directing water from the first water bottle;

a spray nozzle that can be removably attached to the hose, the spray nozzle having a trigger operated valve for allowing intermittent flow of pressurized water from the hose;

a faucet that can be removably attached to the hose, the faucet including an on-off valve for permitting a stream of water to flow from the hose; and a carrying case for carrying the first and second water bottles, the carrying case comprising:

first and second receptacles for receiving the first and second water bottles;

a bracket for removably fastening the faucet; and a carrying handle.

10. The portable washing system of claim 9 further comprising a soap dispenser.

11. The portable washing system of claim 10 wherein the carrying case further comprises a third receptacle for holding the soap dispenser.

12. The portable washing system of claim 9 wherein the carrying case further comprises a storage compartment.

* * * * *